US009668582B2

(12) United States Patent
Cybulski

(10) Patent No.: US 9,668,582 B2
(45) Date of Patent: Jun. 6, 2017

(54) LINEAR ADJUSTMENT MECHANISM

(71) Applicant: Ram Machines (1990) Ltd., Concord, Ontario (CA)

(72) Inventor: Marian Cybulski, Toronto (CA)

(73) Assignee: Ram Machines (1990) Ltd. (CA)

( * ) Notice: Subject to any disclaimer, the term of this patent is extended or adjusted under 35 U.S.C. 154(b) by 34 days.

(21) Appl. No.: 14/850,510

(22) Filed: Sep. 10, 2015

(65) Prior Publication Data

US 2016/0206104 A1 Jul. 21, 2016

Related U.S. Application Data

(60) Provisional application No. 62/103,728, filed on Jan. 15, 2015.

(51) Int. Cl.

| | |
|---|---|
| ***A47C 7/46*** | (2006.01) |
| ***A47C 7/40*** | (2006.01) |
| ***A47C 1/03*** | (2006.01) |

(52) U.S. Cl.

CPC ..... *A47C 7/402* (2013.01); *A47C 1/03* (2013.01)

(58) Field of Classification Search

CPC .. A47C 7/402; A47C 1/03; A47C 7/54; A47C 7/40; A47C 1/032; A47C 1/03255; A47C 7/462; A47C 7/46; B60N 2/02

See application file for complete search history.

(56) References Cited

U.S. PATENT DOCUMENTS

| | | | | |
|---|---|---|---|---|
| 4,043,592 | A * | 8/1977 | Fries | A47C 7/402 297/291 |
| 4,384,742 | A | 5/1983 | Wisniewski | |
| 4,451,084 | A * | 5/1984 | Seeley | A47C 7/402 248/297.31 |
| 4,561,693 | A | 12/1985 | Brownlie et al. | |
| 4,639,039 | A * | 1/1987 | Donovan | A47C 7/402 248/297.31 |
| 4,660,885 | A * | 4/1987 | Suhr | A47C 7/402 248/429 |
| 4,720,071 | A | 1/1988 | Nelson et al. | |
| 4,749,230 | A * | 6/1988 | Tornero | A47C 7/402 248/244 |
| 5,037,158 | A * | 8/1991 | Crawford | A47C 7/402 248/297.31 |
| 5,234,187 | A | 8/1993 | Teppo et al. | |

(Continued)

*Primary Examiner* — Beth Stephan

(74) *Attorney, Agent, or Firm* — Chumak & Company LLP; Yuri Chumak

(57) ABSTRACT

According to embodiments described in the specification, a linear adjustment mechanism for a chair includes first and second structural members adapted to be connected to a chair seat and chair back respectively and coupled to one another for relative sliding movement along an axis. The mechanism further includes a rack on the first structural member extending in a direction of the axis and a pin member positioned in an opening of the second structural member for engaging with the rack. The pin member includes one or more bore openings. One or more spring members are carried by the second structural member for moving the pin member between respective limits of travel of the first and second structural members with respect to one another along the axis. The spring members are disposed through the bore opening for coupling the spring members relative to the pin member.

6 Claims, 9 Drawing Sheets

(56) References Cited

U.S. PATENT DOCUMENTS 5,324,096 A * 6/1994 Schultz ..... A47C 1/03 297/353
5,382,077 A 1/1995 Stumpf et al.
5,588,766 A * 12/1996 Lai ..... A45B 19/06 248/297.31
5,649,741 A 7/1997 Beggs
5,685,609 A 11/1997 Miotto
5,695,249 A * 12/1997 Lotfi ..... A47C 7/402 297/353
5,735,577 A * 4/1998 Lin ..... A47C 1/03 297/353
5,765,920 A * 6/1998 Lai ..... A47C 1/03 248/297.31
5,879,054 A * 3/1999 Cao ..... A47C 1/03 248/297.31
5,918,938 A * 7/1999 Miotto ..... A47C 7/402 248/297.31
5,951,107 A * 9/1999 Tornero ..... A47C 7/402 297/353
6,264,276 B1 * 7/2001 Chen ..... A47C 7/402 297/353
6,276,757 B1 * 8/2001 Brown ..... A47C 7/402 297/353
6,299,253 B1 * 10/2001 Chen ..... A47C 7/402 297/353
6,540,296 B1 4/2003 Shats et al.
6,631,953 B2 * 10/2003 Lai ..... A47C 7/402 297/353
6,709,059 B1 * 3/2004 Cvek ..... A47C 7/402 297/353
6,824,218 B1 * 11/2004 van Hekken ..... A47C 1/03 297/411.36
7,188,901 B2 3/2007 Helmond et al.
7,360,837 B1 * 4/2008 Liu ..... A47C 7/402 297/353
7,775,593 B2 * 8/2010 Hu ..... A47C 7/402 297/353
8,020,934 B2 * 9/2011 Hu ..... A47C 7/402 297/353
8,128,309 B2 * 3/2012 Tsai ..... A47C 7/402 297/411.36
2003/0057756 A1 * 3/2003 Lai ..... A47C 7/402 297/353
2010/0244531 A1 * 9/2010 Pai ..... A47C 1/03 297/411.36

* cited by examiner

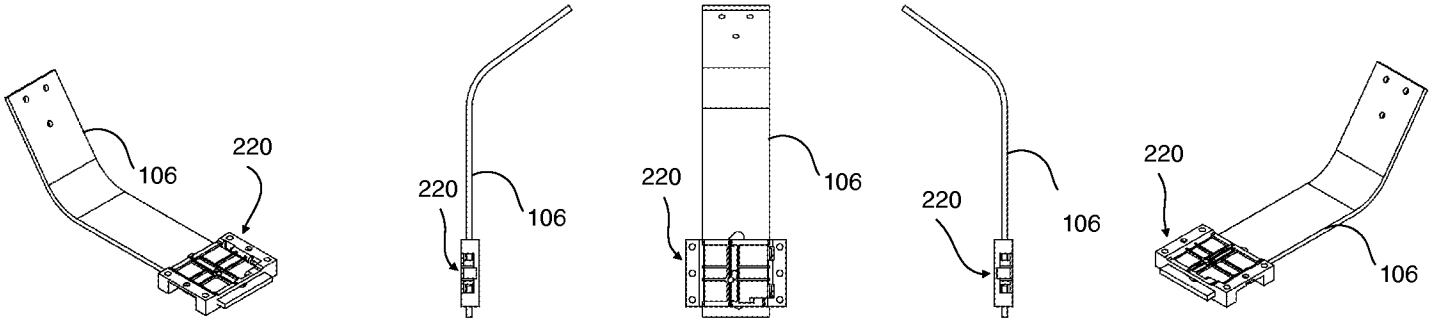
FIG. 5
FIG. 6
FIG. 7
FIG. 8
FIG. 9
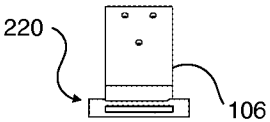
FIG. 10
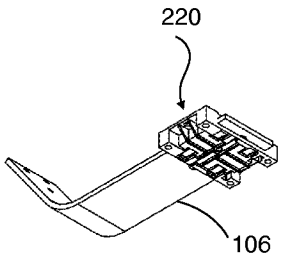
FIG. 11
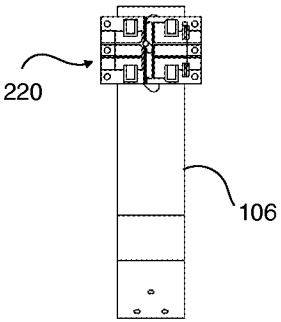
FIG. 12
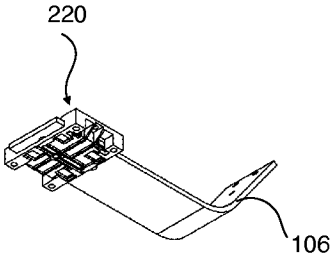
FIG. 13

LINEAR ADJUSTMENT MECHANISM

FIELD OF TECHNOLOGY

The present disclosure relates to chairs and, in particular, to adjustment mechanisms for chairs. Certain embodiments provide a linear adjustment mechanism for a chair.

BACKGROUND

Various techniques have been developed for providing adjustment mechanisms for chair components such as chair backs or rests, arms, seats, among others. One common design of a vertical adjustment mechanism for a chair back includes a bar that extends upwardly from the chair seat. The bar fits into a sleeve attached to the backrest. The bar features a vertical slot defining a rack having a plurality of teeth. A pawl or pin secured to the sleeve is urged into engagement with the rack, for example by use of springs, and the boundaries of the teeth provide discrete positions of the backrest selectable by the user. To prevent dislocation of the springs, which can reduce the performance of the adjustment mechanism leading to failure, prior approaches have attempted to attach the springs to the sleeve through the use of covering plates, and to provide pockets or cavities within the sleeve for the (pre-tensioned) springs. It can be a challenge to shape the pockets correctly when fabricating sleeves in large quantities using an injection molding process. More generally, it is desirable to reduce the number of required parts and to extend the useful life of the springs and the reliability of the adjustment mechanism.

Improvements in linear adjustment mechanism are desirable, including those for chairs. For example, there is a need for the design and development of a linear adjustment mechanism that is reliable and secure, and simple and less costly to manufacture in scale and with fewer parts.

The foregoing examples of the related art and limitations related thereto are intended to be illustrative and not exclusive. Other limitations of the related art will become apparent to those of skill in the art upon a reading of the specification and a review of the drawings.

BRIEF DESCRIPTION OF THE DRAWINGS

Examples are illustrated with reference to the attached drawings. It is intended that the examples and figures disclosed herein be considered illustrative rather than restrictive.

FIG. 5 through FIG. 13 are perspective views of the linear adjustment mechanism of FIG. 1.

DETAILED DESCRIPTION

The following describes a linear adjustment mechanism for a chair that includes first and second structural members adapted to be connected to a chair seat and chair back respectively and coupled to one another for relative sliding movement along an axis. The mechanism further includes a rack on the first structural member extending in a direction of the axis and a pin member positioned in an opening of the second structural member for engaging with the rack. The pin member includes one or more bore openings. One or more spring members are carried by the second structural member for moving the pin member between respective limits of travel of the first and second structural members with respect to one another along the axis. The one or more spring members are disposed through the one or more bore openings for coupling the spring member relative to the pin member.

Throughout the following description, specific details are set forth in order to provide a more thorough understanding to persons skilled in the art. However, well-known elements may not be shown or described in detail to avoid unnecessarily obscuring of the disclosure. Accordingly, the description and drawings are to be regarded in an illustrative, rather than a restrictive, sense.

This disclosure relates generally to chairs and particularly to a linear adjustment mechanism for a chair.

Figure 1:
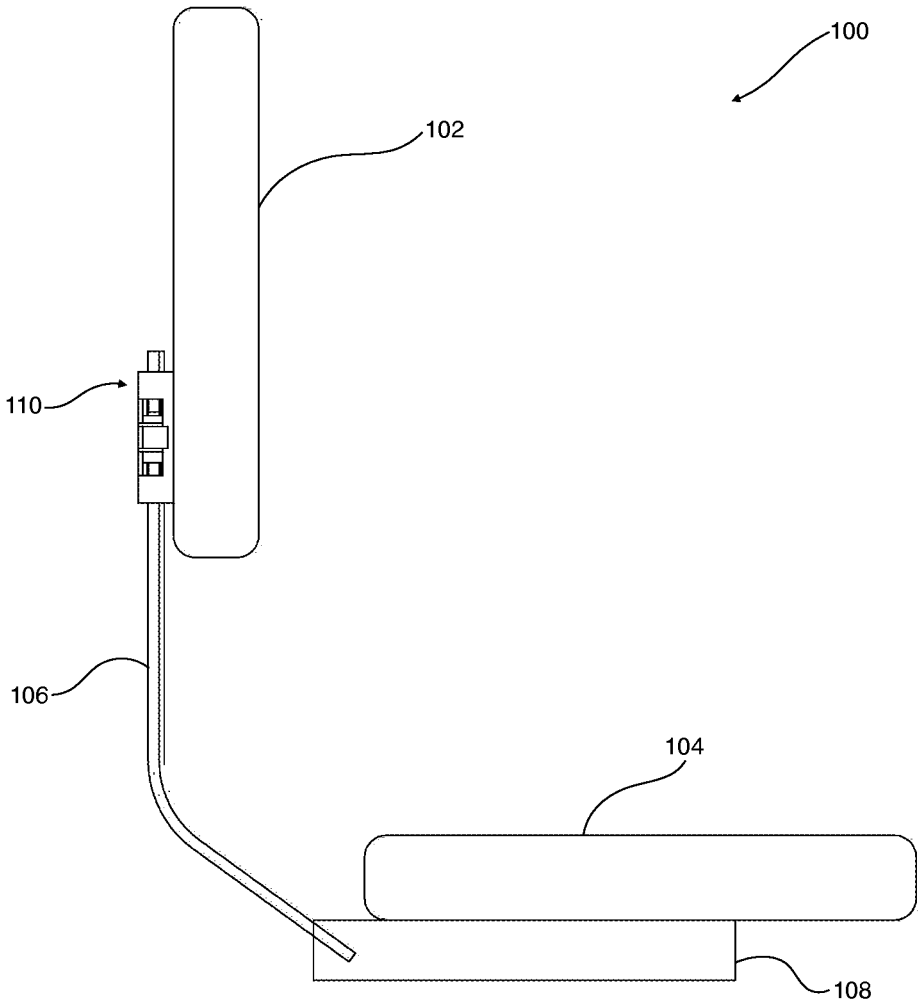
FIG. 1 is a side view of a chair including a linear adjustment mechanism in accordance with an example.

Referring first to FIG. 1, a linear adjustment mechanism in accordance with the present specification is generally indicated by reference numeral 110 and is shown in association with an office chair 100. The chair 100 has a base, part of which is indicated at 108, that supports a seat 104, and a back 102 that is coupled to the base 108 (e.g. with fasteners via openings 202 shown in FIG. 2A) by the adjustment mechanism 110. The adjustment mechanism 110 includes first and second structural members, namely an arm or bar 106 and a carriage or sleeve 220 (shown in FIG. 2A).

Figure 2A:
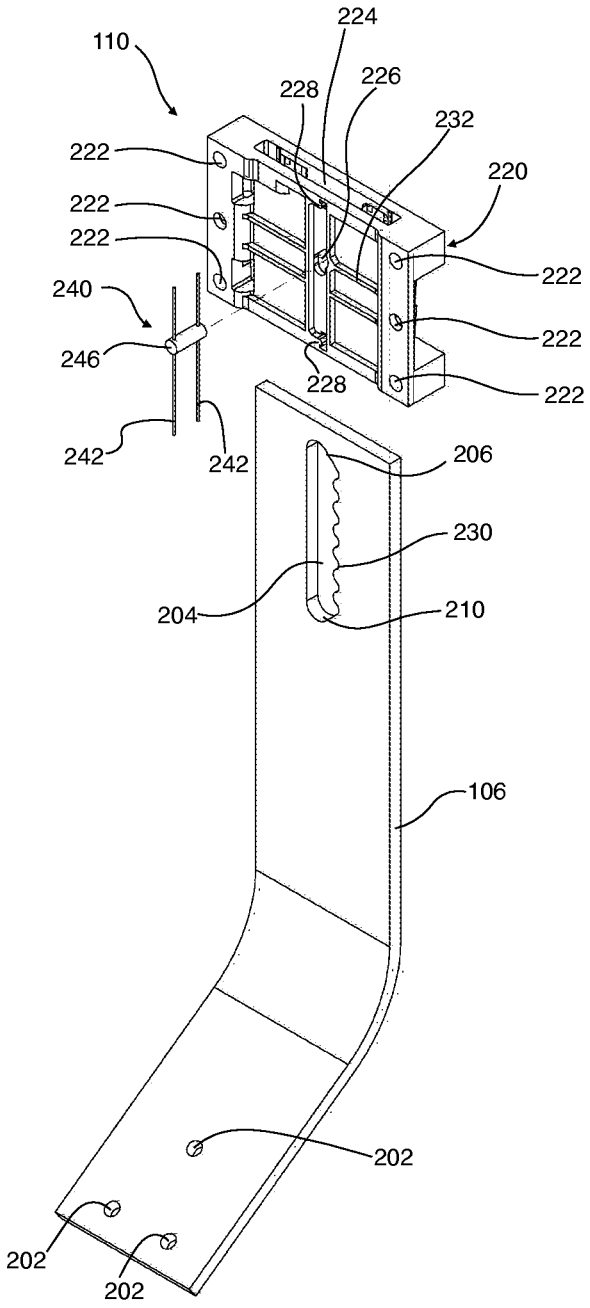
FIG. 2A is a left perspective exploded view of the linear adjustment mechanism of FIG. 1.
Figure 2B:
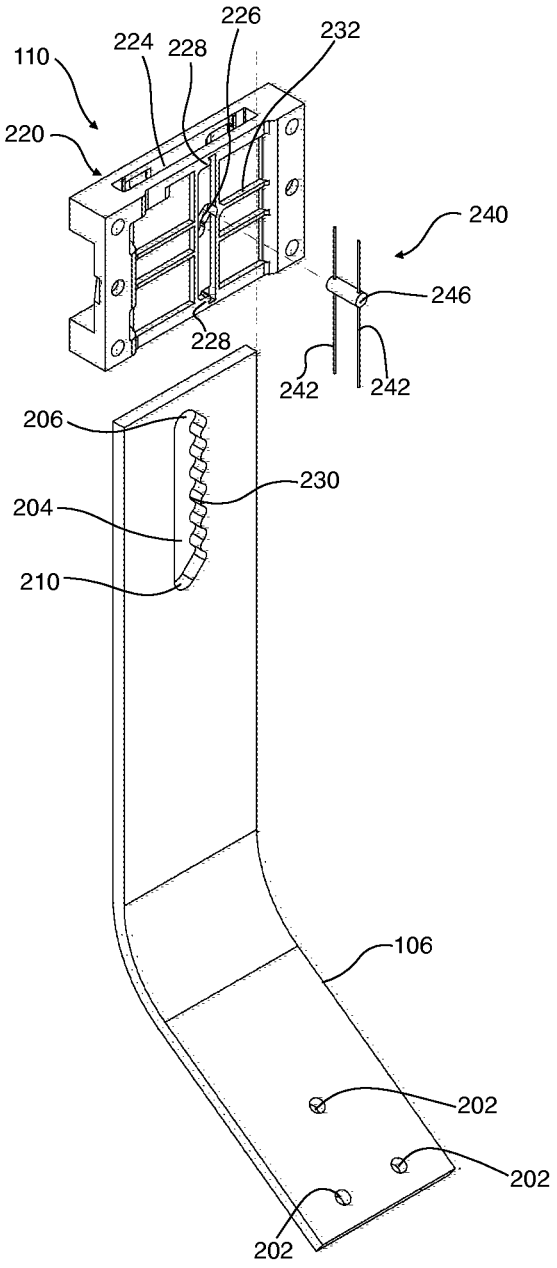
FIG. 2B is a right perspective exploded view of the linear adjustment mechanism of FIG. 1.

As best seen in FIG. 2A as well as in the perspective drawings at FIG. 5 through FIG. 13, bar 106 is generally J-shaped and includes a horizontal portion that is coupled to the seat 104 via the chair base 108, and a vertical portion that extends upwardly behind the back 102.

Sleeve 220 is mounted to slide up and down the vertical portion of bar 106 along a defined axis and is secured to the back 102 (e.g., with fasteners via openings 222).

Bar 106 is essentially a flat rectangular section steel bar having a right-angled configuration J-shape or straight configuration. Sleeve 220 is designed to embrace the vertical portion of bar 106 so that the sleeve 220 can slide up and down on the bar 106. The principal components of the sleeve 220 are a housing that defines a recess 224 generally complementary to the cross-sectional shape of the vertical portion of bar 106. The housing lies in sliding contact with the outer face of the vertical portion of the bar 106.

The linear adjustment mechanism of the present specification allows the back 102 to be ratcheted upwards or raised in increments from a bottom position to a top position. Once the sleeve 220 reaches the top of its travel with respect to the vertical portion of bar 106, the mechanism releases and the sleeve 220 (and back 102) can be slid freely down the vertical portion of bar 106, from which the adjustment process can be resumed.

FIG. 2A shows the adjustment mechanism 110 in an exploded view above the vertical portion of bar 106.

The vertical portion of bar 106 is formed with a vertically elongate, generally rectangular recess 204 having a top edge 206 and a bottom edge 210, one vertical side edge of which is fitted with a rack having multiple teeth 230. In one example, the recess 204 can be integrally formed as part of the bar 106.

According to one example, sleeve 220 includes a housing 232 that is a plastic molding, the shape of which is best seen in FIG. 2A. Sleeve 220 includes an opening 226 that accommodates a pawl or pin member 240 including a lock pin 246. The lock pin 246 can be cylindrical and is shaped and positioned to engage the teeth 230. The lock pin 246 is biased into engagement with the rack defined in the bar 106. The boundaries of the teeth 230 of the rack provide discrete positions of the back 102 selectable by the user.

According to one example of the present specification, lock pin 246 is secured by one or more biasing or spring members, such as one or more springs 242, positioned at opposing sides of the housing of the sleeve 220. In this example, the springs 242 not only secure or couple the lock pin 246 to the housing, but also bias the lock pin 246 into engagement with the rack of the bar 106. The one or more spring members can be configured in a substantially horizontal or vertical orientation, or any other orientation, so long as the spring members when engaged are capable of providing a biasing force upon the lock pin 246 against the rack of the recess 204. The spring member can be any material exhibiting a spring quality and can be sized to fit a channel (i.e., to permit bending of the spring member) in the housing of the sleeve 220, described in more detail below.

To prevent dislodging of the springs 242, the lock pin 246 can include two bore openings through which the springs 242 are threaded. Use of the term "bore opening" in the present specification refers to a narrow shaft formed in the lock pin 246 and extends to any technique of manufacture including stamping, drilling, and the like. Use of this configuration permits the springs 242 to be kept in a straight resting position, avoiding the need to install the springs 242 with pre-tension. As well, this configuration simplifies the design of the housing because the springs do not need fine, molded pockets or cavities to be held into position when under tension; rather, the springs 242 are held in position by virtue of being threaded through the bore openings of the lock pin 246. Moreover, this configuration avoids the need to secure the springs 242 to the sleeve 106 with covering plates. And, one or more channels in the housing of the sleeve 220, each corresponding to the spring 242, terminate in upper and lower lips 228 that provide a deflection zone for each end of the spring 242.

In operation, the lock pin 246 engages the rack when the sleeve 220 is in position on bar 106. The lock pin 246 pivots between at least two positions relative to the housing of the sleeve 220: a first, engaged position, a second, travel (lock) position. The shape of the opening 226, in this example, a V-shape (i.e., having a lower chamber), permits the movement of the lock pin 246 relative to the housing within the recess 204.

The lock pin 246 is in the engaged position after a user has selected a desired vertical height. In this position, the lock pin 246 is in biased engagement with a "groove" of the rack (between two teeth 230) and only ratcheted (upward) movement is permitted.

In an intermediate (flex) position, achieved by upward movement of the sleeve 220, the lock pin 246 is in biased engagement with the rack in the permitted (upward) direction of movement until the lock pin 246 reaches the next selectable height. And, when the lock pin 246 reaches the top edge 206 of the recess 204, the sloping of the top edge 206 causes the lock pin 246 to change to the second, travel position.

In the second, travel position, the lock pin 246 is not in biased engagement with the rack, but rather is locked or held in a lower portion or chamber of the opening 226. In the travel position, the sleeve can be moved up or down substantially along the length of the recess 204. When the lock pin 246 reaches the bottom edge 210 of the recess 204, the sloping of the bottom edge 210 returns the lock pin 246 from the lower portion of the opening 226 to the engaged position.

In other words, in the engaged and intermediate positions, sleeve 220 moves upwardly in increments to adjust the vertical height of the seat back 102, but downward movement is prevented. In the travel (disengaged) position, sleeve 220 is free to return downwardly. It will be appreciated that the sleeve 220 is automatically disengaged when the sleeve 220 reaches the upper limit of its travel, and is re-engaged at the lower limit of its travel.

Figure 3A:
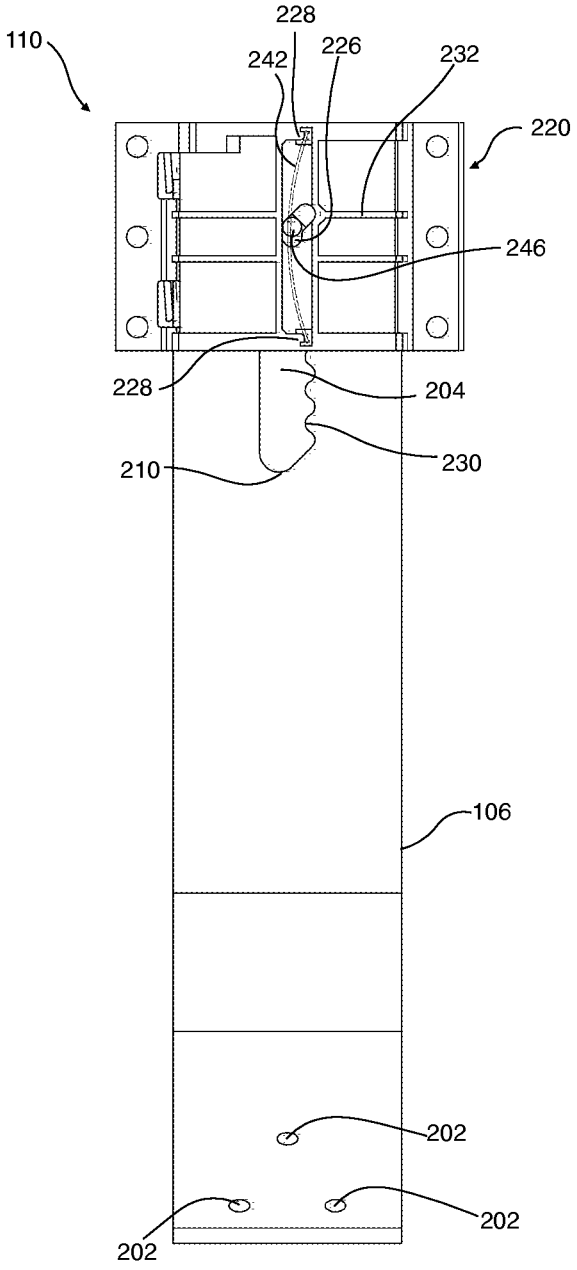
FIG. 3A is a front view of the linear adjustment mechanism of FIG. 1, with a lock pin in a first (flex) position and a sleeve in an upper position.
Figure 3B:
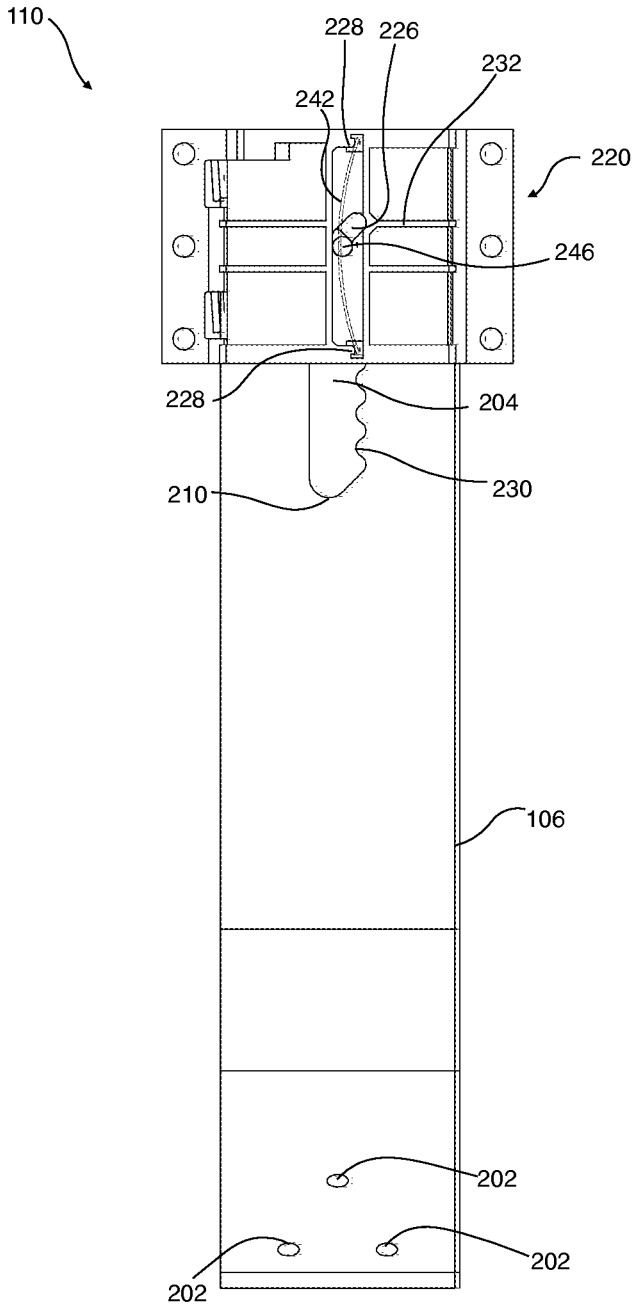
FIG. 3B is a front view of the linear adjustment mechanism of FIG. 3A, with the lock pin in a second (lock) position and the sleeve in the upper position.
Figure 3C:
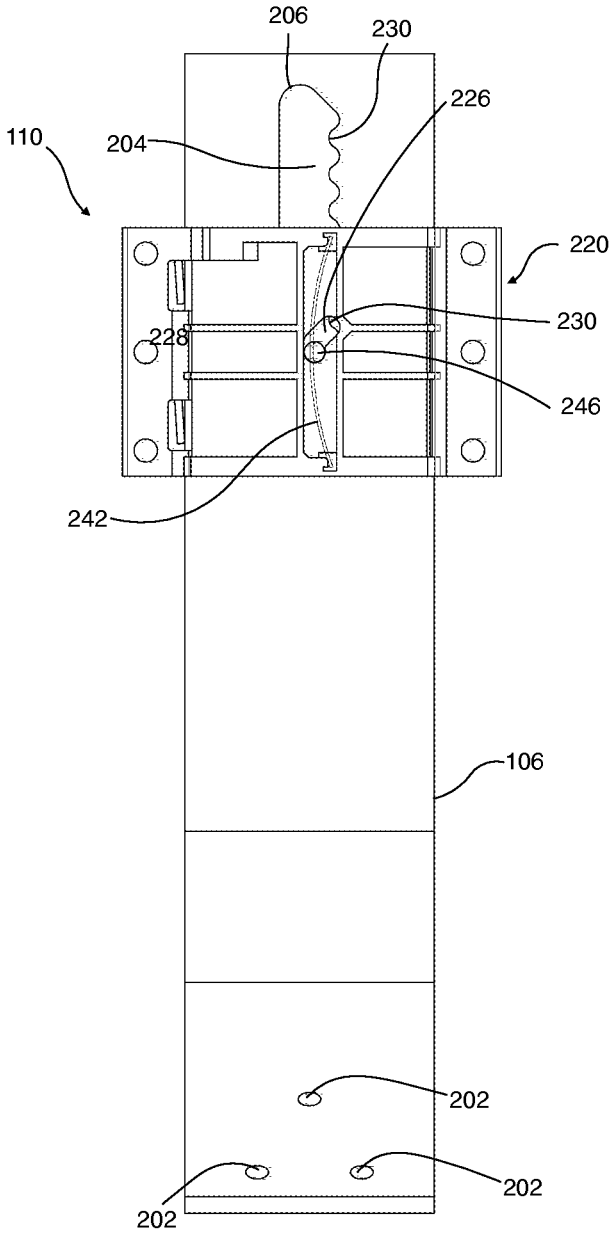
FIG. 3C is a front view of the linear adjustment mechanism of FIG. 3A, with the lock pin in the second (lock) position and the sleeve in a lower position.
Figure 4A:
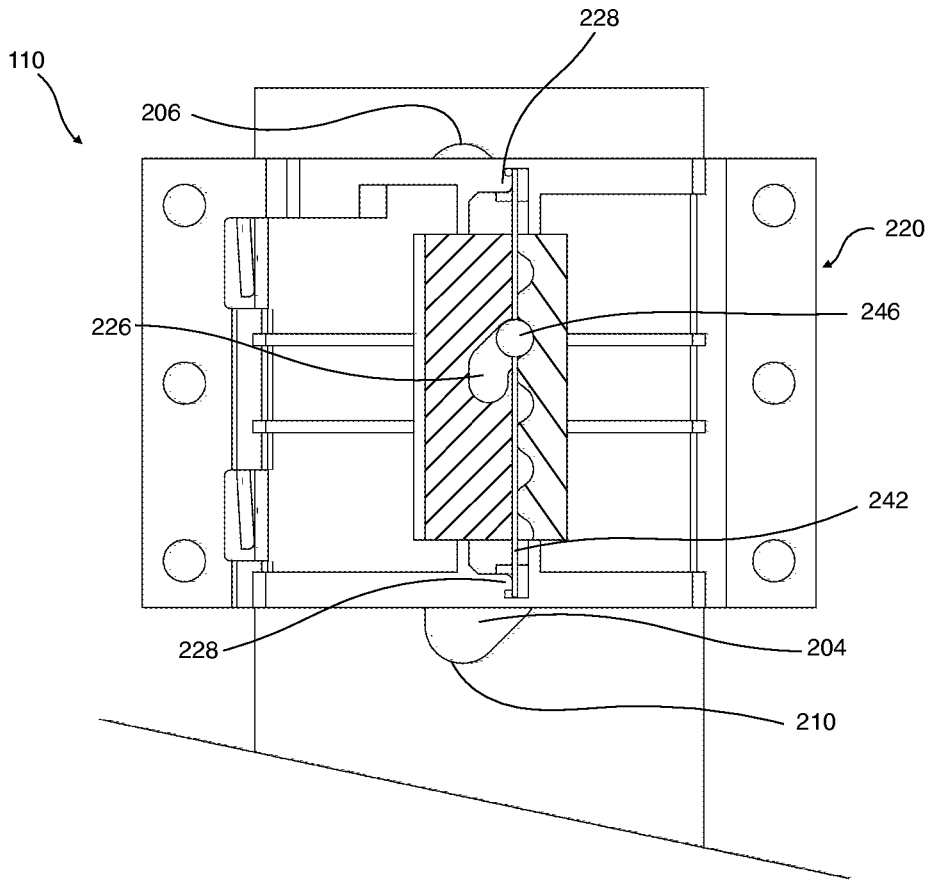
FIG. 4A is a front view, enlarged and partly sectioned, of the linear adjustment mechanism of FIG. 1, with a lock pin in a third (engage) position and a sleeve in a middle position.
Figure 4B:
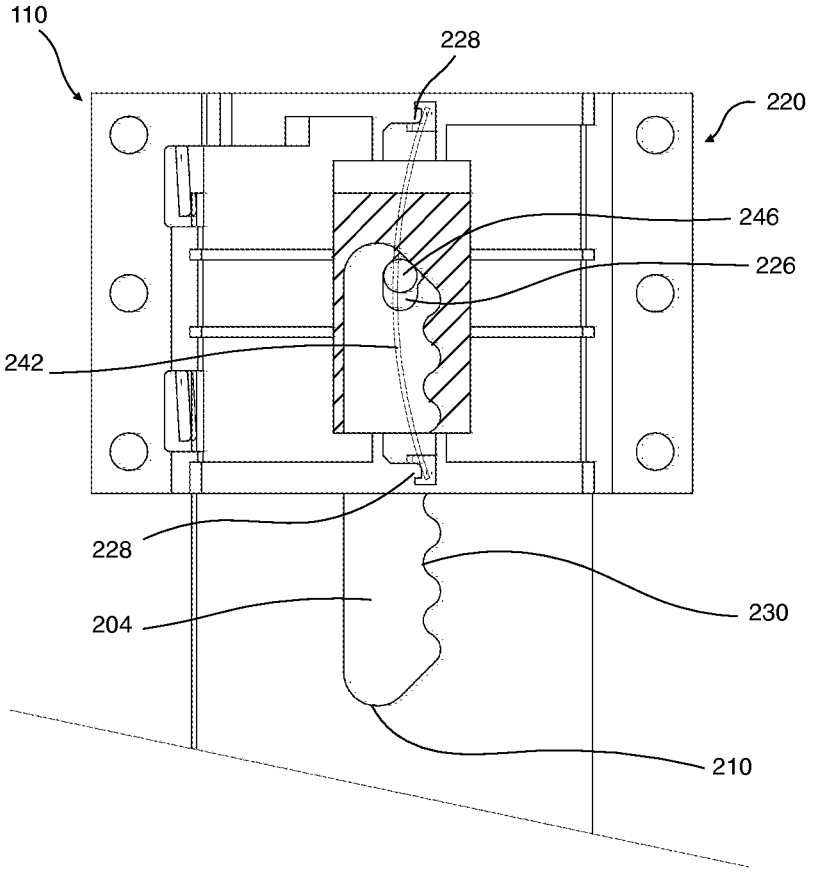
FIG. 4B is a front view, enlarged and partly sectioned, of the linear adjustment mechanism of FIG. 1, with the lock pin in a first (flex) position and the sleeve in an upper position.

FIGS. 3A, 3B, 3C, 4A and 4B best show this sequence of events. In FIG. 3A, sleeve 220 is moving towards the upper limit of its travel and the lock pin 246 is in intermediate, flex position as the lock pin 246 slides to reach a lower portion of the opening 226. FIG. 4B illustrates this view with a section of the housing of the sleeve 220 removed.

In FIG. 3B, the lock pin 246 has completed the sliding and is in the second (free) travel or locked position. The sleeve 220 can then move freely down on bar 106. In FIG. 3C, the lock pin 246 is still in travel position and the sleeve 220 has moved towards the lower limit of its travel. In FIG. 4A, the sleeve 220 is in the first, engaged position mid-rack. The sectional view afforded by FIG. 4A shows that the spring 242 is in a straight position. Downward movement is prevented by the biasing of the lock pin 246 against the teeth 230 in the opening 226.

In other words, the user moves the back 102 upwardly in increments until the desired adjusted position is reached. The back 102 will then remain in that position (unless further adjustments is made) and is prevented from moving down by engagement of the lock pin 246 with the rack of the recess 204.

It will of course be appreciated that the preceding description relates to a particular example of the present specification and that many modifications are possible.

For example, a different form of biasing or spring member could be provided for moving the lock pin 246 between its engaged and disengaged positions. The spring member could be disposed in a generally vertical or horizontal orientation without departing from the scope of the present specification.

More generally, the arrangement could be reversed so that the back is adjusted in the downward direction by movement of sleeve 220.

Also, the structural design could be reversed so that the rack is provided on the sleeve 220 and the lock pin on the bar 106. It might even be possible for the sleeve 220 to be connected to the chair seat and the bar 106 to the back. For example, the arm could extend downwardly into engagement with a sleeve supported by a bracket on the seat base.

Having said that, it is believed that the design of the disclosed examples combines the virtues of simplicity and low cost with functionality and efficiency.

Fine incremental adjustment can be provided by providing a fine pitch rack. Variations in tolerance between bar 106 and sleeve 220, for example, due to variations in the width of bar 106 can be controlled by means of molded plastic tabs or other known techniques.

In an alternative example, sleeve 220 could be made as two complimentary moldings that embrace the bar 106, rather than as a single molded housing.

Furthermore, it will be appreciated that the linear adjustment mechanism can be applied to vary other chair dimensions such as the positions of chair arms, the positions of a neck rest, and so on, without departing from the scope of the present specification. An optional clamp can be added to further secure a user-selected position and to reduce movement.

The present specification provides a linear adjustment mechanism for a chair. The mechanism includes first and second structural members adapted to be connected to a chair seat and chair back respectively and coupled to one another for relative sliding movement along an axis. The mechanism further includes a rack on the first structural member extending in a direction of the axis and a pin member positioned in an opening of the second structural member for engaging with the rack. The pin member includes one or more bore openings. One or more spring members are carried by the second structural member for moving the pin member between respective limits of travel of the first and second structural members with respect to one another along the axis. The one or more spring members are disposed through the one or more bore opening for coupling the one or more spring members relative to the pin member.

The first structural member can be a bar that is adapted to extend upwardly from the seat. The second structural member can be a sleeve carried by the bar that is adapted to be coupled to the back of the chair.

The bar can be formed with a recess defining the rack. The pin member and the spring member can be disposed in the recess and carried by the sleeve. The rack can extend along a side edge in engagement with the pin member.

The pin member can include a lock pin. The opening in the sleeve can include a lower chamber and can be adapted to accommodate at least two positions of the lock pin within the recess: a first position when the lock pin is in engagement with the rack permitting ratcheted upward adjustment of the sleeve relative to the bar and a second position when the lock pin has slid to the lower chamber of the sleeve, removed from engagement with the rack, permitting free adjustment of the sleeve relative to the bar, and wherein the recess has a top edge and a bottom edge, and the lock pin is slid into the first position by a shaping of the bottom edge and the lock pin is slid into the second position by a shaping of the top edge.

The limits of travel can be determined by movement of the lock pin between the top edge and the bottom edge of the recess.

Each spring member can include a spring. The sleeve can include a housing and a channel defined in the housing adapted to accommodate each spring. The housing can include deflection zones to permit bending of each spring. The one or more springs can selectively retain the pin member against the rack in the first position and a lower chamber of the opening in the second position.

A pair of springs each disposed in a bore opening of the lock pin can be positioned in a pair of channels defined in opposite faces of the housing.

A chair include a seat having a bar extending upwardly from the seat, a back having a sleeve coupled to the bar for relative sliding movement along an axis, a recess including a rack on the bar extending in a direction of the axis. The sleeve can include a housing, an opening including a lower chamber, a lock pin positioned within the opening for engaging with the rack, and a pair of springs disposed in a pair of bore openings in the lock pin and positioned within a pair of channels defined in opposite faces of the housing. The springs can retain the lock pin during movement between respective limits of travel defined by the recess in one of two positions: a first position when the lock pin is in engagement with the rack permitting ratcheted upward adjustment of the sleeve relative to the bar and a second position when the lock pin has slid to the lower chamber of the opening, removed from engagement with the rack, permitting free adjustment of the sleeve relative to the bar, and wherein the recess has a top edge and a bottom edge, and the lock pin is slid into the first position by a shaping of the bottom edge and the lock pin is slid into the second position by a shaping of the top edge.

While a number of exemplary aspects and examples have been discussed above, those of skill in the art will recognize certain modifications, permutations, additions and sub-combinations thereof.

The invention claimed is:

1. A linear adjustment mechanism for a chair including a seat and a back comprising:

first and second structural members adapted to be connected to the seat and the back respectively and coupled to one another for relative sliding movement along an axis;

a rack on the first structural member extending in a direction of the axis;

a pin member positioned in an opening of the second structural member for engaging with the rack, the pin member comprising one or more bore openings;

one or more spring members carried by the second structural member for biasing the pin member during movement between respective limits of travel of the first and second structural members with respect to one another along the axis;

wherein the one or more spring members are disposed through the one or more bore openings for coupling the one or more spring members relative to the pin member;

wherein the first structural member is a bar that is adapted to extend upwardly from the seat, and wherein the second structural member is a sleeve carried by the bar and is adapted to be coupled to the back of the chair; and wherein the bar is formed with a recess defining the rack, and wherein the pin member and the one or more spring members are disposed in the recess and carried by the sleeve, and wherein the rack extends along a side edge in engagement with the pin member.

2. The linear adjustment mechanism of claim 1, wherein the pin member comprises a lock pin, and the opening in the sleeve comprises a lower chamber and is adapted to accommodate at least two positions of the lock pin within the recess: a first position when the lock pin is in engagement with the rack permitting ratcheted upward adjustment of the sleeve relative to the bar and a second position when the lock pin has slid to the lower chamber of the sleeve, removed from engagement with the rack, permitting free adjustment of the sleeve relative to the bar, and wherein the recess has a top edge and a bottom edge, and the lock pin is slid into the first position by a shaping of the bottom edge and the lock pin is slid into the second position by a shaping of the top edge.

3. The linear adjustment mechanism of claim 2, wherein the limits of travel are determined by movement of the lock pin between the top edge and the bottom edge of the recess.

4. The linear adjustment mechanism of claim 3, wherein each spring member comprises a spring, and the sleeve comprises a housing and one or more channels defined in the housing adapted to accommodate the one or more spring members, the housing further comprising deflection zones to permit bending of each spring, the one or more springs for selectively retaining the pin member against the rack in the first position and a lower chamber of the opening in the second position.

5. The linear adjustment mechanism of claim 4 comprising a pair of springs each disposed in a bore opening of the lock pin and positioned in a pair of channels defined in opposite faces of the housing.

6. A chair comprising:

a seat comprising a bar extending upwardly from the seat;

a back comprising a sleeve coupled to the bar for relative sliding movement along an axis;

a recess comprising a rack on the bar extending in a direction of the axis;

the sleeve including a housing, an opening comprising a lower chamber, a lock pin positioned within the opening for engaging with the rack, and a pair of springs disposed in a pair of bore openings in the lock pin and positioned within a pair of channels defined in opposite faces of the housing, the springs for retaining the lock pin during movement between respective limits of travel defined by the recess in one of two positions: a first position when the lock pin is in engagement with the rack permitting ratcheted upward adjustment of the sleeve relative to the bar and a second position when the lock pin has slid to the lower chamber of the opening, removed from engagement with the rack, permitting free adjustment of the sleeve relative to the bar, and wherein the recess has a top edge and a bottom edge, and the lock pin is slid into the first position by a shaping of the bottom edge and the lock pin is slid into the second position by a shaping of the top edge.

* * * * *